US007854847B2

(12) United States Patent
Li

(10) Patent No.: US 7,854,847 B2
(45) Date of Patent: Dec. 21, 2010

(54) PROCESS OF PURIFYING WOOD PULP WITH CAUSTIC-BORATE SOLUTION AND RECOVERING THE PURIFYING CHEMICAL

(75) Inventor: Jian Li, Richmond Hill, GA (US)

(73) Assignee: Rayonier TRS Holdings Inc., Jessup, GA (US)

( * ) Notice: Subject to any disclaimer, the term of this patent is extended or adjusted under 35 U.S.C. 154(b) by 0 days.

(21) Appl. No.: 11/595,103

(22) Filed: Nov. 9, 2006

(65) Prior Publication Data

US 2008/0110586 A1 May 15, 2008

(51) Int. Cl.
*D21C 3/22* (2006.01)
*B01D 61/00* (2006.01)

(52) U.S. Cl. ..... 210/652; 162/42; 162/43; 162/44; 162/45; 162/80; 210/651; 8/125

(58) Field of Classification Search ..... 162/55, 162/42, 43, 44, 45, 80; 210/651, 652; 8/125
See application file for complete search history.

(56) References Cited

U.S. PATENT DOCUMENTS 3,068,141 A 12/1962 MacClare et al.
3,305,433 A 2/1967 Partlow
3,635,670 A 1/1972 Kennedy
3,873,413 A 3/1975 Fisher
4,269,656 A 5/1981 Perkins
4,270,914 A * 6/1981 Dahl ..... 8/125
5,279,739 A 1/1994 Pemawansa
5,415,734 A 5/1995 Backlund et al.
5,462,641 A 10/1995 Bergvist et al.
5,589,053 A 12/1996 Moran et al.
5,853,535 A 12/1998 Maples et al.
6,770,168 B1 8/2004 Stiggson
6,896,810 B2 5/2005 Ali et al.
6,946,057 B2 9/2005 Stiggson
2002/0088567 A1 7/2002 Henricson et al.
2004/0020854 A1 2/2004 Ali et al.
2004/0074615 A1 4/2004 Nguyen
2004/0177935 A1 9/2004 Hamed et al.
2004/0206464 A1 10/2004 Li et al.
2005/0098280 A1 * 5/2005 Stigsson ..... 162/37
2005/0203291 A1 9/2005 Svenson et al.
2005/0256470 A1 11/2005 Hamed et al.
2005/0263258 A1 12/2005 Hamed et al.
2005/0279467 A1 12/2005 Thomas et al.
2005/0284593 A1 12/2005 Sundman et al.
2006/0016751 A1 1/2006 Ali et al.
2006/0049106 A1 3/2006 Nurminen et al.

OTHER PUBLICATIONS

Szoke et al., Cobalt(III) EDTA complex removal from aqueous alkaline borate solutions by nanofiltration, Desalination, Issue 2 vol. 175, May 20, 2005.*
Koch Membrane Systems [downloaded from interent archive], Nanofiltration-overview,Koch Membrane Systems, Sep. 12, 2005 [downloaded Jan. 23, 2008].*
International Search Report Dated Apr. 3, 2008 for International Application No. PCT/US07/23605.

* cited by examiner

*Primary Examiner*—Matthew J. Daniels
*Assistant Examiner*—Anthony J Calandra
(74) *Attorney, Agent, or Firm*—Hunton & Willimas LLP

(57) ABSTRACT

Systems and methods for purifying wood pulp by caustic-borate extraction. The systems and method include a method for recovering both the caustic and borate compounds from the resultant hemicaustic effluent, so that they may be recycled and re-used. Efficient recovery of these components is enabled by a nanofiltration system that has one or more alkali-resistant nanofiltration membranes.

23 Claims, 4 Drawing Sheets

PROCESS OF PURIFYING WOOD PULP WITH CAUSTIC-BORATE SOLUTION AND RECOVERING THE PURIFYING CHEMICAL

BACKGROUND

1. Field of the Art

The embodiments relate, in general, to a process for purifying wood pulp fibers using a caustic-borate extraction to dissolve hemicellulose from the fibers. More particularly, the embodiments relate to a caustic-borate extraction process including a method for recovering the caustic and the borate from the hemicaustic effluent stream, using a nanofiltration membrane.

2. Description of Related Art

It is well known to those of ordinary skill in the art of wood pulp processing to use an alkaline treatment process, such as "mercerization," "cold caustic treatment," or "cold caustic extraction." Cold caustic extracted fibers may be used in a variety of applications, including as a raw material in the production of regenerated fibers, such as rayon or cellulose acetate. Cold caustic extraction beneficially reduces the hemicellulose content of cellulosic fibers. Hemicellulose is generally defined as low molecular weight polysaccharaide units inherently present in all cellulosic fibers. Hemicellulose is particularly problematic in the production of regenerated fibers, because the hemicellulose clogs spinneret holes during fiber formation.

In general, alkaline treatments such as cold caustic extractions are performed by mixing a low consistency cellulose slurry with an alkaline solution, and allowing the mixture to extract for a suitable amount of time for the hemicellulose to be dissolved and diffuse out of the fiber walls. The extracted cellulose fiber is subsequently washed to remove the caustic solution and the dissolved hemicellulose, and then may be subjected to downstream processing. The effluent stream produced during washing, aptly referred to as a "hemicaustic" stream, generally contains a mixture of extracted hemicellulose, alkali metal hydroxide and water.

The handling and disposal of hemicaustic streams traditionally have been problematic. While the hemicaustic streams may be used in other pulp production processes, they are of limited use, and their disposal poses environmental concerns. The hemicaustic effluent streams and alkali metal hydroxide solutions associated with alkaline treatment process typically require specialized handling procedures to ensure that such materials are not discharged to the environment. In addition to environmental concerns, the economic value of the hemicellulose contained within the hemicaustic stream is lost if the hemicellulose is not recovered. As such, methods have been disclosed for the recovery of hemicellulose and alkali hydroxides from the hemicaustic stream. For example, U.S. Pat. No. 6,896,810 to Ali et al., which is hereby incorporated by reference in its entirety, proposes a system and process by which a portion of the alkaline solution may be recovered from the hemicaustic effluent stream and recycled back into the alkaline treatment system. The process includes a nanofiltration system to remove the hemicellulose from the spent caustic extraction liquor, i.e., the hemicaustic.

It has been disclosed that the addition of boron compounds to the caustic extraction solution further enhances the extraction of impurites from wood pulps. For example, U.S. Pat. No. 3,068,141 to MacClaren, et al., which is hereby incorporated by reference in its entirety, discloses the preparation of a refined cellulose product from a kraft wood product. The refining procedure includes treating the wood pulp using a strong aqueous alkali, such as aqueous sodium hydroxide, containing a boron compound, such as boric acid or $Na_2B_4O_7$, followed or preceded by an extraction procedure using dilute alkali solution at high temperatures. U.S. Pat. No. 3,305,433, to Partlow, which is hereby incorporated by reference in its entirety, discloses a cold caustic refining treatment for cellulose that includes a soluble borate in a caustic solution. The solution inhibits the mercerizing effect of the concentrated cold caustic solution without adversely affecting its solvent power for hemicellulose and other impurities.

However, despite the potential advantages of the caustic-borate wood pulp extraction process these treatment processes have not been commercialized, to date, because there does not currently exist a viable use for the caustic-borate hemicaustic effluent produced, nor a viable method for recovering both the NaOH and the borate from the hemicaustic effluent. Traditionally, hemicaustic effluent streams have been recycled as soda makeup in the kraft pulping processes, or in alkaline extraction stages in a bleaching operation. However, having borate in the hemicaustic stream creates many processing problems, rendering them unsuitable for use in either process. And while methods for recovering caustic from the hemicaustic stream have been disclosed, none of these methods addresses the recovery of caustic-borate solution from a hemicaustic effluent stream. Indeed, the use of borate complicates the recovery of sodium hydroxide from hemicaustic effluent. See Pulp and Paper Manufacture, Vol. 4: Sulfite Sci. & Tech., 238 (M. J. Kocurek et al. eds., 1985). Because there has been no efficient method for recovering and recycling the costly caustic-borate solution, the caustic-borate extraction systems have not been commercialized.

The description herein of certain advantages and disadvantages of known processes, methods, and treatment compositions, is not intended to limit the scope of the embodiments. Indeed, the embodiments may include some or all of the processes, methods, and treatment compositions described above without suffering from the same disadvantages.

SUMMARY

In view of the foregoing, the present embodiments provide systems and methods for a caustic-borate wood pulp extraction process. More particularly, the present embodiments provide systems and processes by which a portion of the caustic (NaOH) and borate are recovered from the hemicaustic effluent streams and recycled back into the extraction process. The present embodiments further provide systems and processes by which the hemicellulose contained in such hemicaustic streams is recovered, which may then be used as feedstock in higher value end uses.

It is therefore a feature of an embodiment to provide a method of recovering a caustic-borate extraction solution from a hemicaustic effluent stream. The method of this embodiment comprises providing an aqueous hemicaustic stream comprising a caustic compound, a borate compound, and hemicellulose, and passing the hemicaustic stream through a nanofiltration system that comprises at least one alkali-resistant nanofiltration membrane, thereby producing a permeate stream. The nanofiltration membrane filters the hemicaustic stream such that greater than about 30% by weight of the borate in the hemicaustic stream and greater than about 50% by weight of the caustic in the hemicaustic stream passes through the nanofiltration system to the permeate stream. However, less than about 20% by weight of the hemicellulose in the hemicaustic stream passes through the nanofiltration system to the permeate stream.

These and other objects, features and advantages will appear more fully from the following detailed description of the preferred embodiments.

These and other objects, features and advantages will appear more fully from the following detailed description of the preferred embodiments.

DETAILED DESCRIPTION OF PREFERRED EMBODIMENTS

Various embodiments described herein provide a system and method for caustic-borate extraction of cellulosic fibers, including a system and method for separating and recycling the caustic and borate from a hemicaustic effluent stream using a nanofiltration system.

For purposes of clarity and illustration only, the systems and methods of the present embodiments are generally described herein in relation to cellulosic fibers derived from wood pulp. However, the systems and methods of the present embodiments may be used in conjunction with any cellulosic fiber derived from any source. Exemplary cellulosic fibers include, but are not limited to, those derived from wood, such as wood pulp, as well as non-woody fibers from cotton, from straws and grasses, such as rice and esparto, from canes and reeds, such as bagasse, from bamboos, from stalks with bast fibers, such as jute, flax, kenaf, cannabis, linen and ramie, and from leaf fibers, such as abaca and sisal. It is also possible to use mixtures of one or more cellulosic fibers.

Cellulosic pulp fibers suitable for use in the present embodiments may be derived from either a softwood pulp source or hardwood pulp source or mixtures thereof. Exemplary softwood pulp sources include trees such as various pines (Slash pine, Loblolly pine, White pine, Caribbean pine), Western hemlock, various spruces, (e.g., Sitka Spruce), Douglas fir and/or mixtures of same. Exemplary hardwood pulp sources include trees such as sweet gum, black gum, maple, oak, eucalyptus, poplar, beech, and aspen or mixtures thereof.

As used herein, the term "fiber" or "fibrous" is meant to refer to a particulate material wherein the length to diameter ratio of such particulate material is greater than about 10. In certain embodiments, the cellulosic fibers are characterized by an average length, e.g., a WAFL length, between about 0.1 and 6 mm. In various aspects of the embodiments the average fiber length is between about 0.8 and 4 mm. However, although generally described in relation to fibers, the systems and methods of the embodiments may be beneficially employed to produce alkaline treated non-fibrous cellulosic products, as well.

The embodiments will now be described more fully with reference to the accompanying drawings in which some, but not all, embodiments are illustrated.

Figure 1:
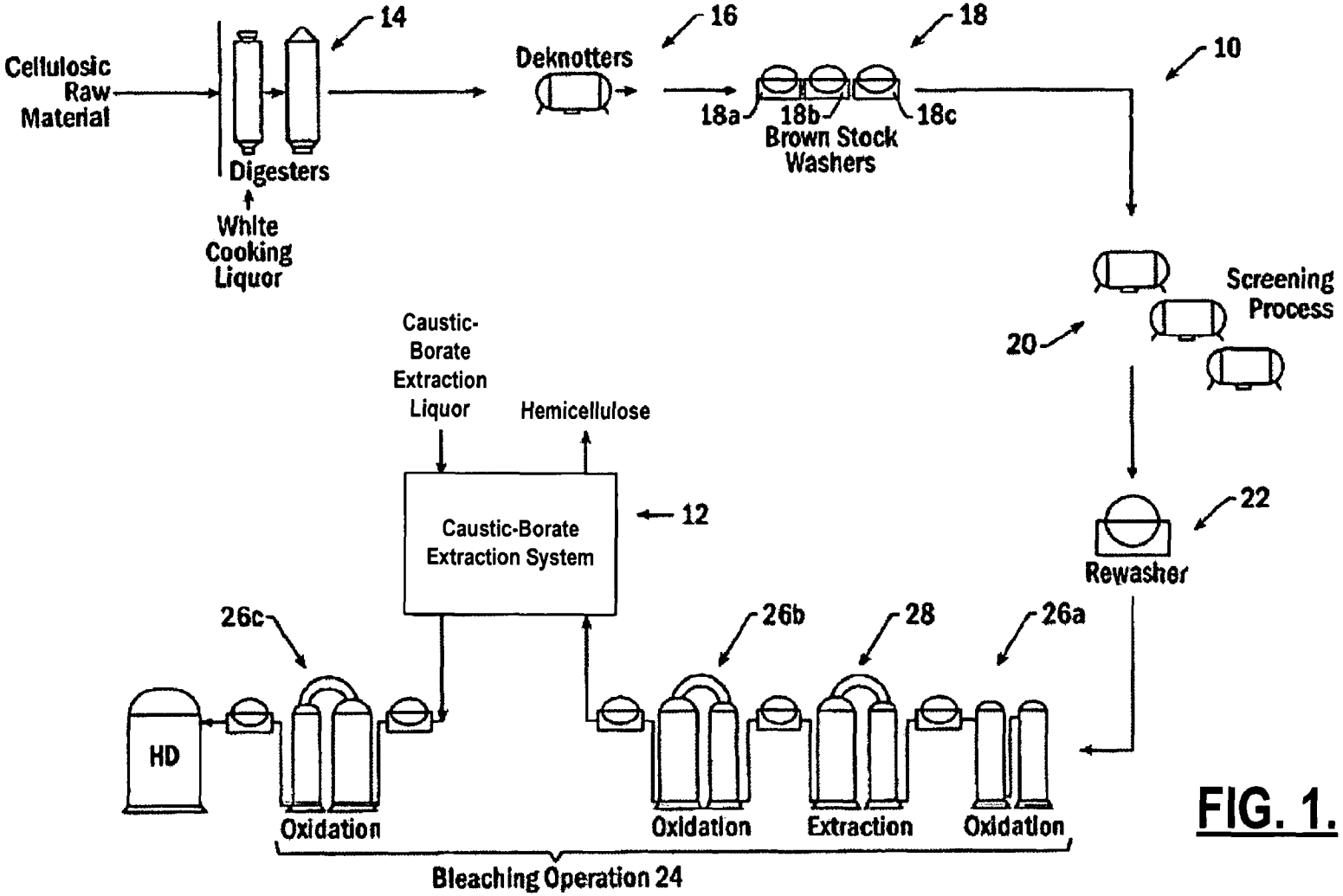
FIG. 1 is a schematic drawing of a wood pulping operation in accordance with an embodiment described herein.

Referring now to FIG. 1, an exemplary process for producing cellulosic fibers via a wood pulping operation 10 employing an caustic-borate extraction system 12 is provided. Wood pulping operations generally entail a series of steps, such as digestion, deknotting and the like, that separate the pulp into individual fibers and remove impurities from the pulp. The wood pulping operation 10 illustrated in FIG. 1 is referred to in the art as a kraft pulping process; however, the systems and methods of the embodiments are suitable for use in chemical pulping operations such as, but not limited to, sulfite pulping operations, and organic solvent pulping operations, as well.

Unless specified to the contrary, flow rates and processing conditions, i.e., pressures, temperatures, dwell times, and raw materials employed in the various steps within the wood pulping operation 10 are those conventional in the art of wood pulping.

As shown in FIG. 1, the wood pulping operation 10 begins by introducing cellulosic raw material, i.e. wood chips, into one or more digesters 14, along with a sufficient quantity of white cooking liquor. As known in the art, the wood chips may be fed to the digester 14 as is, exposed to pre-steaming before entering the digester 14 or steam packed in the digester 14. The digester 14 may be operated in a continuous or batch mode. In certain embodiments, a continuous digester 14 is employed. Broadly defined, continuous digesters generally comprise a vertical processing member with a top chip inlet section, one or more sections for digesting the chips with alkali and a washing section in the bottom portion thereof.

Inside the digester 14, the wood chips are initially pre-hydrolyzed in steam, water, or dilute mineral acid at elevated temperature (150-180° C.) for up to 2 hours. Pre-hydrolysis can be carried out before the digester 14. The pre-hydrolyzed wood chips are then cooked for a period of time under sufficient heat and pressure to separate the fibers used to produce kraft pulp using conventional chemical pulping charges, temperatures and cooking times known in the art of kraft pulping. Following cooking, the wood chips may be optionally rinsed within the digester 14 and then introduced as a cellulosic slurry into one or more deknotters 16. Knots removed by the deknotter may be discharged from the system and/or they may be returned to the digester 14 for further treatment. Any deknotters 16 known in the art may be used in conjunction with the present embodiments.

The wood pulp stream exiting the deknotter 16 is transported to one or more brown stock washers 18. The brown stock washers 18 remove the spent chemicals and impurities out of the pulp. In a conventional kraft system there are usually a series of such brown stock washers 18 in which the pulp is washed in progressively cleaner water, with the wash water moving countercurrently against the progression of the pulp from washer to washer so that the cleanest pulp is washed with the cleanest water in the last washer 18*c* and the dirtiest pulp is washed with the dirtiest water in the first washer 18*a*.

As shown in FIG. 1, the wood pulp exiting the brown stock washers 18, also commonly referred to as the brown stock, is transported to a screening process 20 and rewasher 22 to further remove debris from the brown stock, and increase the consistency of the pulp.

After exiting the rewasher 22, the wood pulp stream typically enters a bleaching operation 24. Any bleaching process known in the art may be suitable for use in the present embodiments. The bleaching operation 22 provided in FIG. 1 generally includes a series of oxidation and extraction steps (performed in oxidation vessels 26*a-c* and extraction tower 28, respectively) intended to remove lignin from the wood pulp exiting the rewasher 22. The oxidation and extraction steps may be performed using any equipment, processes and materials known in the art of wood pulp bleaching. In one advantageous embodiment, chlorine dioxide is used as the oxidizing chemical in the oxidation step. The chlorine dioxide is generally employed in the amounts and conditions known in the art of wood pulp oxidation. In a further advantageous embodiment, a weak alkaline solution may beneficially be employed to extract, i.e. solubilize, the oxidized lignin out of the wood pulp during the extraction step. The weak alkaline solution is generally employed in the amounts and conditions known in the art of wood pulp extraction.

As shown in FIG. 1, an alkaline treatment system, such as a caustic-borate extraction system 12, may be incorporated into the bleaching operation 24. Applicants note that although the advantageous embodiment of FIG. 1 illustrates the incorporation of a caustic-borate extraction system 12 of the present embodiments within the bleaching operation 24, the caustic-borate extraction system may beneficially be inserted into a wood pulping operation 10 at any point after the initial digesters 14.

Figure 2:
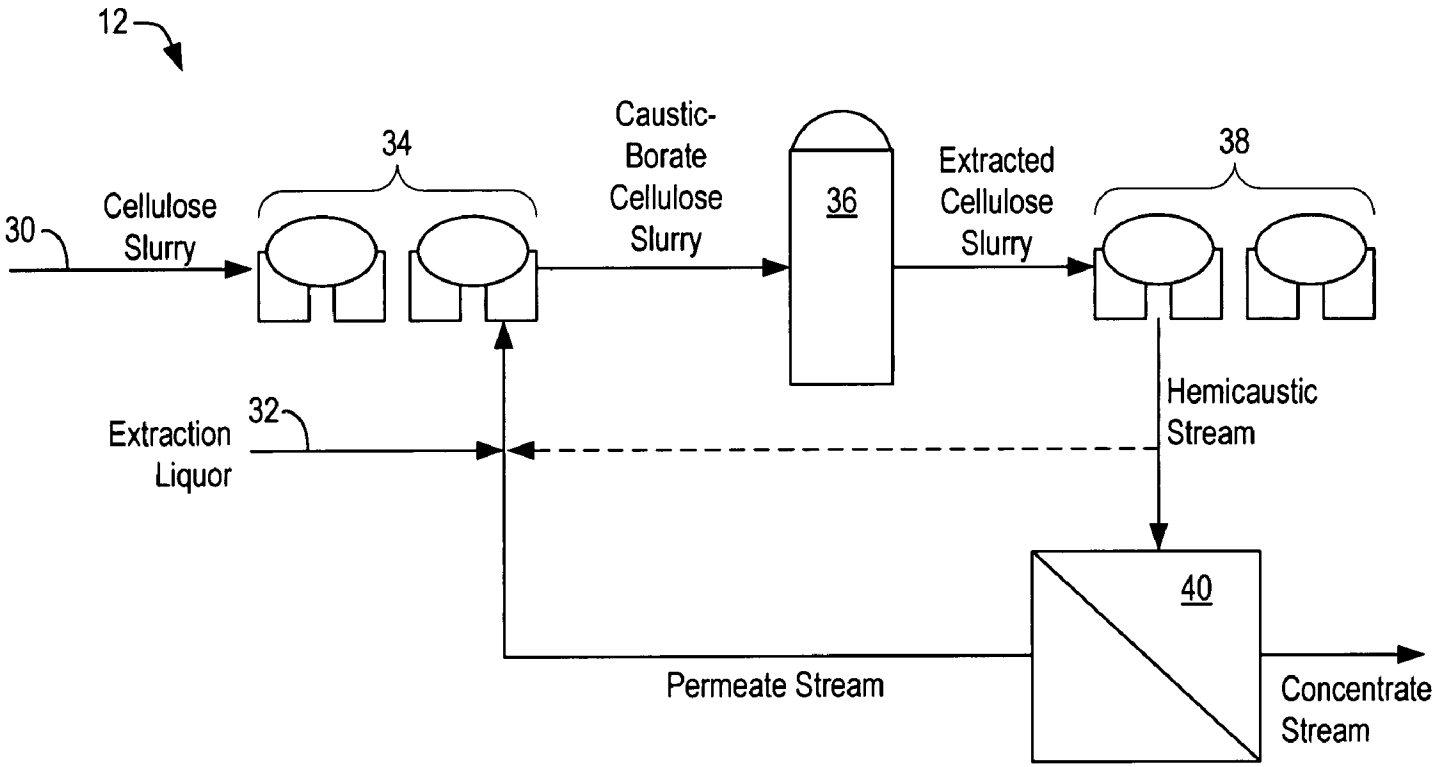
FIG. 2 is a schematic drawing of a caustic-borate extraction system in accordance with one embodiment described herein.

As illustrated in FIG. 2, the caustic-borate extraction system 12 of the embodiments generally includes a cellulose slurry feed 30; an extraction liquor supply feed 32; at least one pre-extraction washer 34 to combine the cellulose slurry and extraction liquor; at least one caustic-borate extraction unit 36; at least one post-extraction cellulose washer 38 to remove the hemicaustic from the extracted cellulose slurry; and a nanofiltration system 40 to treat the effluent hemicaustic stream. The caustic-borate extraction system 12 of the present embodiments typically treats wood pulp streams in the form of cellulosic slurries at flow rates and concentrations typical of those known in the art.

As noted above, the cellulosic fibers are generally supplied to the caustic-borate extraction system 12 in the form of a cellulose wood pulp slurry, which is then combined with an alkaline, or caustic-borate, solution. The incoming cellulose slurry entering the caustic-borate extraction system 12 from the wood pulping operation 10 typically has a consistency of up to 15 wt %, to ease bulk transport properties and the like. As used herein, the term "consistency" refers to the concentration of the cellulosic fibers present in the cellulose slurry. Consequently, the consistency will be presented as a weight percent representing the weight amount of the cellulosic fibers present in the cellulose slurry divided by the total weight amount of cellulosic slurry, multiplied by 100.

The extraction liquor supply system 32 provides an extraction liquor containing a caustic-borate solution to the caustic borate extraction system 12. The caustic-borate solution generally includes a caustic compound, i.e. a compound capable of providing a pH of above 7, dispersed in water, and a source of borate ions.

The caustic compound in the extraction liquor is typically formed from at least one alkali metal salt. Suitable alkali metal salts include, but are not limited to, sodium hydroxide, potassium hydroxide and mixtures thereof. In an alternative embodiment, ammonium hydroxide may be employed as the caustic compound. The concentration of caustic in the extraction liquor introduced into the pre-extraction washer system 34 typically ranges from about 3 wt % to about 50 wt %. In one embodiment, the concentration of the caustic compound in the extraction liquor introduced into the mixing system 34 is about 25 wt %. The extraction liquor introduced into the pre-extraction washer system typically exhibits a pH above 12.

The borate ions may be provided to the extraction liquor, for example, by soluble borate or as boric acid. By incorporating borate ions into the extraction liquor, the caustic concentration may be increased, thereby increasing the refining power of the extraction liquor without mercerizing the wood pulp fiber at a given temperature. The amount of boric acid or borate required to inhibit the mercerization of the alkali solution for a given native cellulose varies with the concentration of the caustic extraction liquor and alkaline cellulose slurry. For example, at 35° C. for a cellulose slurry containing 10% total titratable alkali (expressed as percent NaOH), from about 6.0 wt % to about 8.0 wt % borax, or equivalent boric acid, is required to prevent mercerization and still obtain good extraction. With increasing concentrations of caustic, more borax, or boric acid, will be required until for slurries containing 16% total titratable alkali, as much as about 25.5 wt % to 27.5 wt % borax, or the equivalent boric acid, should be present. Total titratable alkali is defined as the amount of alkali (expressed as NaOH) that can be measured by titrating to pH 7 with a standard acid solution.

As will be understood by one of ordinary skill in the art, the amount and concentrations of the extraction liquor and cellulose slurry may be varied as necessary to produce a caustic-borate cellulose slurry having predetermined properties. Preferably, sufficient extraction liquor is supplied to the pulp leaving the pre-extraction washer system 34, and entering the extraction tower 36 to produce a caustic-borate cellulose slurry having a low consistency (less than 10%, preferably about 3% to about 4%). Preferably, the amount of caustic in the extraction liquor is sufficient to provide a caustic-borate cellulose slurry exiting the washing system 34 containing about 2 wt % to about 20 wt % caustic compound. More preferably, the caustic-borate cellulose slurry exiting the washing system 34 contains about 7 wt % to about 14 wt % caustic compound. Preferably, the amount of borate in the extraction liquor is sufficient to provide a caustic-borate cellulose slurry containing from about 0.5 wt % to about 10 wt % borate. Preferably, the caustic-borate cellulose slurry exiting the washing system 34 exhibits a pH near 14.

The incoming extraction liquor is typically supplied to the caustic-borate extraction system 12 at temperatures ranging from about 15° C. to about 100° C. In various embodiments, the extraction liquor supply system 32 comprises a chiller or a heater to provide the extraction liquor at a predetermined temperature.

In the embodiment shown in FIG. 2, the water in the incoming cellulose slurry is gradually displaced by the caustic-borate extraction liquor solution in a pre-extraction washer system 34, having a counter-current flow of caustic-borate solution. An exemplary pre-extraction washer system 34 includes at least one washer unit, and more preferably a series of about two to three washer units. Exemplary washers for use in the present embodiments include, but are not limited to, horizontal belt washers, rotary drum washers, vacuum filters, wash presses, compaction baffle (CB) filters, atmospheric diffusers and pressure diffusers. Preferably, the washers subject the incoming cellulosic slurry to progressively to higher concentrations of the caustic-borate extraction liquor, with the extraction liquor moving counter currently to the progression of the pulp.

Figure 3:
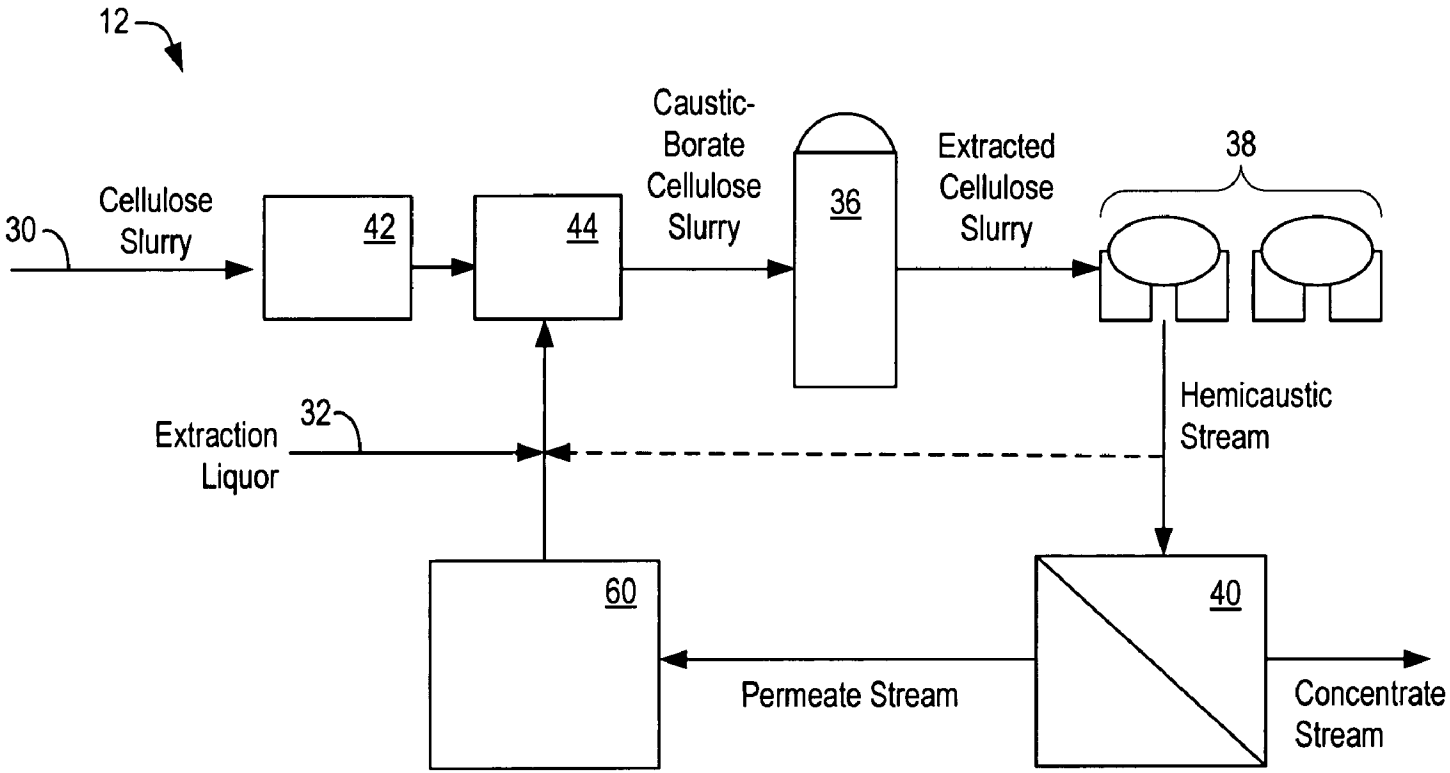
FIG. 3 is a schematic drawing of a caustic-borate extraction system in accordance with another embodiment described herein.

It has been found that when the caustic-borate solution contains a sufficient concentration of borate, a higher concentration of caustic may be introduced to the wood pulp fiber without risking partial mercerization. Thus, in an alternative embodiment (as shown in FIG. 3), the pre-extraction washer system 34 is eliminated, and the extraction liquor is directly combined with a cellulosic fiber slurry. In this embodiment, the incoming cellulosic slurry first is introduced to a slurry concentrator 42 which extracts water from the slurry, thereby increasing its consistency. Preferably, the consistency of the concentrated slurry is more than about 30%, and more preferably up to about 40%. An exemplary slurry concentrator 42 includes at least one press. Suitable presses for use as the slurry concentrator include twin roll presses and screw presses. In advantageous embodiments, at least one twin roll press is utilized as the slurry concentrator. Any twin roll press capable of processing cellulose slurries in accordance with the present embodiments may be employed. One exemplary twin roll press is commercially available from Metso.

In the embodiment illustrated in FIG. 3, the high consistency cellulose slurry exiting the slurry concentrator 42 is blended with the higher concentration caustic-borate extraction liquor in a mixing system 44 to form a caustic-borate cellulose slurry. The mixing system 44 generally includes at least one in-line mixer. The in-line mixer may be any mixer known in the art capable of mixing alkaline cellulose slurries at consistencies of the present embodiments. Exemplary in-line mixers include, but are not limited to screw conveyors, rotor/stator mixers and hydraulic piston mixers. The mixing system 44 may beneficially include two or more mixers, arranged in series. Preferably, sufficient extraction liquor is mixed with the cellulose slurry to produce a caustic-borate cellulose slurry having a low consistency (less than 10%, and preferably about 3% to about 4%), and containing from about 2 wt % to about 20 wt % caustic compound; more preferably, from about 7 wt % to about 14 wt % caustic compound. Preferably, sufficient extraction liquor is mixed with the cellulose slurry to produce a caustic-borate cellulose slurry containing from about 0.5 wt % to about 10 wt % borate. The caustic-borate cellulose slurry preferably exhibits a pH of about 14.

The caustic-borate cellulose slurry exiting the washing system 34 (or alternatively, the mixing system 44) is transported to at least one caustic-borate extraction unit 36 for extracting the caustic-borate cellulose slurry for a sufficient amount of time to dissolve an effective amount of the hemicellulose out of the cellulosic fibers and into the extraction liquor. The caustic-borate extraction unit 36 generally is a large vessel providing suitable agitation and dwell time to allow the caustic-borate cellulosic slurry to effectively extract hemicellulose. Any suitable reactor or vessel may be employed as the caustic-borate extraction unit 36.

In one embodiment, the caustic-borate extraction unit 36 is a reactor, such as an extraction tower, such as typically employed within wood pulp bleaching processes. In further aspects of this embodiment, the final extraction tower within a multi-step wood pulp bleaching operation is employed as the treatment unit. More specifically, in a wood pulp bleaching operation utilizing three oxidation vessels separated from each other by two extraction towers, the second extraction tower, immediately preceding the final oxidation vessel, may be utilized as a treatment unit in accordance with the present embodiments. FIG. 1 illustrates such a configuration, in which a caustic-borate extraction system 12 in accordance with the present embodiments immediately precedes the final oxidation vessel 26*c* within a wood pulp bleaching operation 24. In the advantageous embodiment illustrated in FIG. 1, the cellulosic slurry provided to the caustic-borate extraction system 12 would thus typically be expected to have a fairly low lignin content, as indicated by a brightness above about 65%. The fibers within the cellulosic slurry provided to the caustic-borate extraction system 12 contain up to about 30 wt % hemicellulose.

In contrast to cold caustic extractions, which are typically conducted at comparatively low temperatures (less than about 40° C.), caustic-borate extractions can be performed at higher temperatures while avoiding mercerization, particularly where the cellulose slurry contains a low concentration of borate, and a high caustic concentration. Preferably, the caustic-borate extraction is performed at a temperature within the range of about 20° C. to about 100° C. In one embodiment, in which the caustic-borate cellulose slurry has a borate concentration of 0.5 wt %, and a caustic concentration of 12 wt %, the extraction is conducted at 60° C. without mercerization.

The caustic-borate cellulose slurry is allowed to extract or react within the caustic-borate extraction unit 36 for a sufficient amount of time to dissolve an effective amount of the hemicellulose out of the cellulosic fibers and into the extraction liquor. The caustic-borate cellulose slurry may extract or react within the caustic-borate extraction unit for exemplary dwell times up to 4 hours. In beneficial embodiments, the caustic-borate cellulose slurry is allowed to extract or react for a time sufficient to remove up to 100% of the hemicellulose initially present within the cellulose fibers. Consequently, the extracted cellulose fibers within the cellulosic slurry exiting the caustic-borate extraction unit 36 generally contain no more than about 10% hemicellulose, while the extraction liquor exiting the caustic-borate extraction unit 36 generally contains from about 0.5 wt % to about 7 wt % hemicellulose.

The caustic-borate cellulose slurry within the caustic-borate extraction unit 36 generally comprises cellulose fiber, caustic compound, borate, and water. The caustic-borate cellulose slurry within the extraction unit typically has a low consistency up to 10%. In one embodiment, the caustic-borate extraction unit 36 processes caustic-borate cellulose slurry having a consistency of about 3% to about 4%. The caustic-borate cellulose slurry within the caustic-borate extraction unit 36 preferably contains from about 2 wt % to about 20 wt % caustic, and from about 0.5 wt % to about 10 wt % borate. The pH of the caustic-borate cellulose slurry within the caustic-borate extraction unit 36 is typically near 14.

The extracted cellulose slurry is transported from the caustic-borate extraction unit 36 to at least one post-extraction washer 38, to separate the spent extraction liquor containing the hemicellulose extracted from the cellulosic fibers. The post-extraction washer 38 may be any suitable wet process by which to extract the spent extraction liquor and hemicellulose from the extracted cellulose slurry. Exemplary washers 38 for use in the present embodiments include, but are not limited to, horizontal belt washers, rotary drum washers, vacuum filters, wash presses, compaction baffle (CB) filters, atmospheric diffusers and pressure diffusers. In one advantageous embodiment, the washer 38 is a horizontal belt washer. Horizontal belt washers generally employ a series of showers emitting either fresh or recycled wash water onto the treated cellulose slurry as it travels through the machine on a continuous screen or mesh belt, as known in the art. Similar to the brown stock washers described earlier, horizontal belt washers subject the treated cellulosic slurry to progressively cleaner water, with the wash water moving counter currently against the progression of the pulp from shower to shower so that the cleanest pulp is washed with the cleanest water in the last shower and the dirtiest pulp is washed with the dirtiest water in the first shower. Horizontal belt washers are commercially available as CHEMIWASHER™ from Kadant Black Clawson.

The wash water entering the post-extraction washer 38 is advantageously purified water, such as water that has been transported through a zeolite bed or the like. The wash water may further contain conventional additives known in the art of pulp washing, such as surface tension modifiers and the like. A sufficient amount of wash water is applied to the treated cellulose slurry traveling through the washer 38 to remove up to 100% of the dissolved hemicellulose and up to 100% of the extraction liquor containing the caustic compound from the incoming treated cellulose slurry.

The spent wash water stream exiting the post-extraction washer 38, commonly referred to as the hemicaustic stream, generally includes hemicellulose, unreacted caustic compound from the extraction liquor, and water. The hemicaustic stream exiting the washer 38 typically includes from about 0.5 wt % to about 7 wt % of hemicellulose. The hemicaustic stream exiting the washer 38 further generally includes up to 20 wt % of caustic compound and up to about 8% borate, with the remainder being water and any optional additives that may have been included in either the extraction liquor or wash water. The hemicaustic stream typically exhibits a pH near 14.

The hemicaustic stream exiting the washer 38 has very little pulp fiber, e.g., generally less than about 0.1%. As shown by dashed lines in FIGS. 2 and 3, a portion of the hemicaustic stream exiting the washer 38 optionally may be diverted and used as necessary to adjust the consistency of the cellulose slurry entering the extraction unit.

A portion of the remaining, i.e. undiverted, hemicaustic stream is transported from the post-extraction washer 38 to a nanofiltration system 40 to remove a portion of the hemicellulose from the hemicaustic stream. As used herein, the term "nanofiltration system" refers to a process that uses a filtration membranes having a smaller pore size than those typically used in microfiltration and ultrafiltration processes. "Nanofiltration" refers to filtration through a membrane capable of having a pore size of about 0.5 to about 1.5 nanometers, or molecular weight cut off of about 200 to 1000 (referred to as "daltons"). In contrast, microfiltration filter media has nominal pore sizes of 0.05-2 microns, and ultrafiltration filter media have nominal pore sizes of about 0.0015-0.1 microns or molecular weight cutoff of about 1,000 to 200,000. Microfiltration and ultrafiltration do not provide the ability to separate dissolved hemicellulose from a pulp mill process with a molecular weight of 200 to 1000. Nanofiltration also stands in contrast to "reverse osmosis" (RO), which refers to separation through a membrane with nominal pore size less than about 0.5 nanometer or molecular weight cut off below about 200. Though reverse osmosis provides a high degree of separation and could be used in conjunction with the disclosed methods, use of reverse osmosis membranes is generally not favored because throughput of the membranes is so low at operational pressures (500 psi-1000 psi) that use of the RO membranes is not practical.

The nanofiltration membranes may be formed from a number of different polymers, as known in the art. More particularly, any polymer capable of withstanding the elevated pH's associated with the hemicaustic stream may be employed. Advantageously, the polymer used to form the nanofiltration membrane is capable of withstanding pHs above 14 for an extended period of time. Exemplary materials for use in forming nanofiltration membranes include many commercially available polymers such as polyether sulfone, polysulfone, polyarylether sulfones, polyvinylidene fluoride, polyvinyl chloride, polyketones, polyether ketones, polytetrafluoro ethylene, polypropylene and polyamides and mixtures thereof. The degradation properties of the foregoing polymers may further be improved by altering their molecular weight distribution, as described in U.S. Pat. No. 5,279,739.

By use of nanofiltration membranes having the appropriate nominal molecular weight cut off or pore size, the desired components in the hemicaustic stream, i.e. those having a molecular size smaller than the molecular weight cut off or nominal pore diameter of the nanofiltration membrane, pass through the nanofiltration membrane and exit the nanofiltration system as permeate. The undesired components within the hemicaustic stream, e.g., hemicellulose, having a molecular size larger than the nominal molecular weight cut off of the membrane, are rejected by the nanofiltration membrane and exit the nanofiltration system as a concentrate stream.

As explained in U.S. Pat. No. 6,896,810 to Ali et al. (which is incorporated herein by reference in its entirety), such nanofiltration membranes can be successfully employed in conjunction with hemicaustic streams to recover the hemicellulose and alkali treatment composition. For example, an alkali resistant nanomembrane can separate hemicellulose from NaOH to recover over 90% of the NaOH in the hemicaustic solution.

However, such alkali resistant nanomembranes are expected to reject borate ions. Without being bound by theory, it is believed that alkali resistant nanofiltration membranes, such as those used in the filtration of hemicaustic streams, allow monovalent anions, such as $OH^-$ and $HSO_4^-$, to permeate the membrane, but reject divalent anions, such as $CO_3^=$ and $SO_4^=$. As such, it is expected that sodium borate ($Na_2B_4O_7.xH_2O$), which is commonly in the form of divalent ion $B_4O_7^=$, would be rejected by an alkali resistant membrane. In other words, borate ions would not be expected to pass through the membrane to the permeate stream.

Unexpectedly, the inventors have discovered that under certain conditions, borate ions will pass through these alkaline-resistant nanofiltration membranes. Without being bound by theory, it is believed that when the pH of the hemicaustic stream is above 12, boron's predominant form is that of a monovalent ion ($B(OH)_4^-$), enabling it to pass through the nanofiltration membrane to the permeate stream. Therefore, under certain conditions, the nanofiltration can effectively recover both caustic and borate from a hemicaustic solution.

As illustrated in more detail in the examples below, the inventors have discovered that under the conditions described herein, a nanofiltration unit may effectively be used to recover at least about 30% of the borate in a hemicaustic stream. More preferably, the nanofiltration unit may recover at least about 50%, even more preferably at least about 70%, and even more preferably up to about 90-95% of the borate in the hemicaustic stream.

Figure 4:
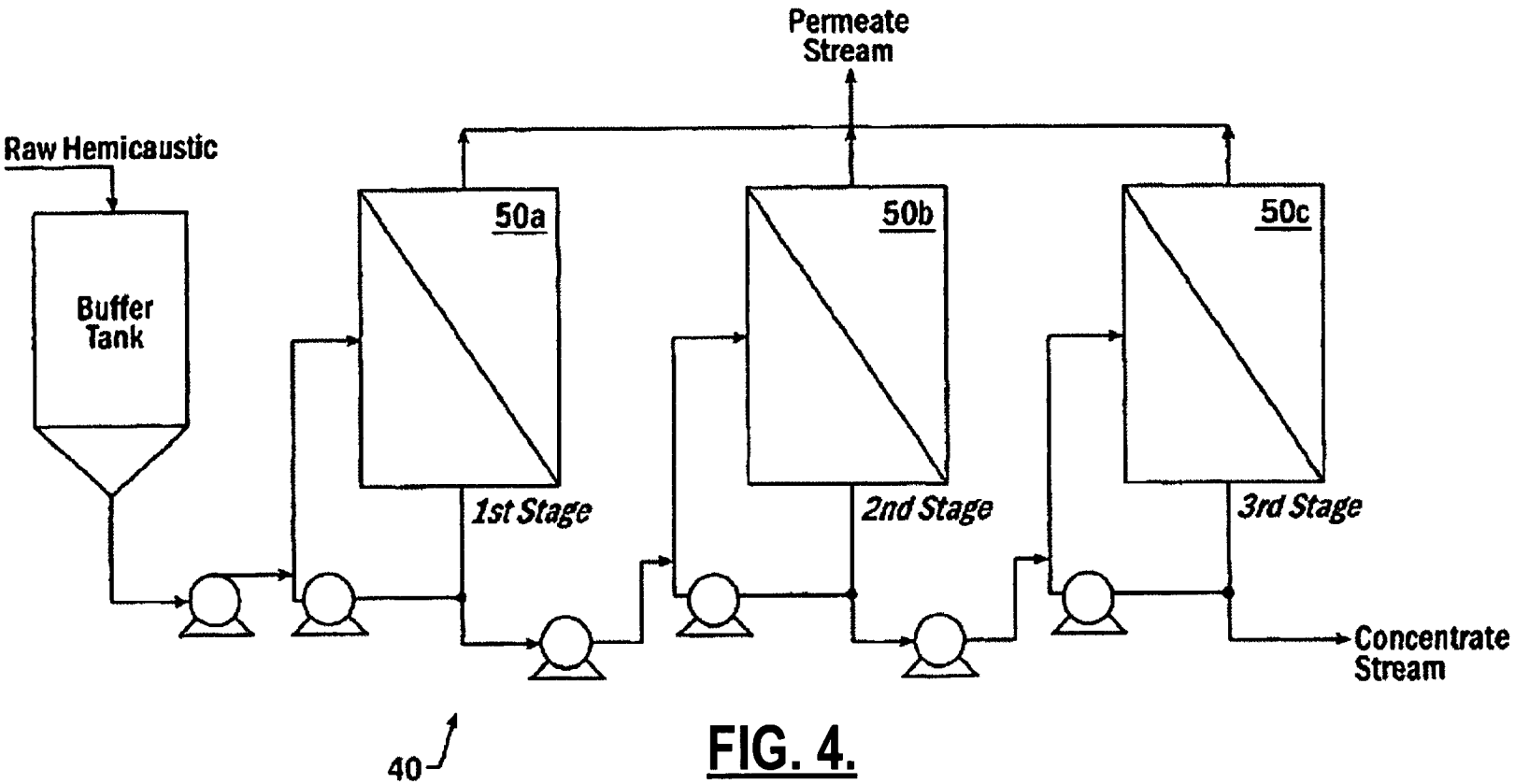
FIG. 4 is a schematic drawing of a nanofiltration system in accordance with one embodiment described herein.

FIG. 4 illustrates a nanofiltration system 40 in accordance with advantageous aspects of the embodiments. The nanofiltration system 40 generally includes at least one nanofiltration unit and beneficially includes a plurality of nanofiltration units. In the embodiment illustrated in FIG. 4, the nanofiltration system 40 includes three nanofiltration units, **50*a*-50*c*. Each nanofiltration unit 50*a*-50*c*** may advantageously include one or more nanofiltration membranes. Nanofiltration membranes for use in the systems of the present embodiments are generally formed from polymers and, in one advantageous embodiment, have a nominal molecular weight cut off of about 200 daltons.

The nanofiltration system 40 may be operated at any temperature known in the art, such as at temperatures of up to about 70° C. In one advantageous embodiment, the nanofiltration system is operated at a temperature of about 50° C. The pressure at which nanofiltration is carried out is advantageously high enough to provide adequate flow through the nanofiltration membrane to achieve desired processing efficiencies. Typically, the nanofiltration system 40 may be operated at a hydrostatic pressure of from about 100 psi to about 500 psi, advantageously from about 300 psi to about 450 psi.

The nanofiltration membrane can be in a number of different configurations and are usually positioned within a cartridge type assembly or module within a larger nanofiltration unit. One of the preferred membrane configurations for use in the present embodiments is commonly referred to as "spiral wound membranes." Spiral wound membranes typically include a centrally positioned permeate or filtrate tube and at least one sheet of a membrane with appropriate spacer and backing that is spirally wound around the permeate or filtrate tube.

Other suitable configurations include nanofiltration units 50 containing tubular membranes where a plurality of tubular membranes (e.g., 3 to 20) are disposed within a modular housing. Flat sheet filter cartridges containing a series of 2 or more spaced apart nanofiltration membrane plates or sheets can also be used as a nanofiltration unit accordance with the present embodiments.

As illustrated in FIG. 4, the nanofiltration system 40 can advantageously include a plurality, of nanofiltration units arranged in series. For example, the nanofiltration system 40 may include three nanofiltration units 50*a*-50*c* arranged in series. In such advantageous embodiments, the additional nanofiltration units 50*b*-50*c* may be arranged so as to filter the concentrate exiting the previous nanofiltration unit 50*a* or 50*b*, thereby increasing the overall efficiency of the nanofiltration system relative to a nanofiltration system having a single nanofiltration unit. For example, a 400 gpm hemicaustic stream may be transported through an initial nanofiltration unit, yielding a 180 gpm permeate stream and a 220 gpm concentrate stream. A second nanofiltration unit can then be used to filter the concentrate stream exiting the first nanofiltration unit, thereby producing a 100 gpm permeate stream and 120 gpm concentrate stream. A third nanofiltration unit can then be used to filter the concentrate stream exiting the second nanofiltration unit, thereby producing a 40 gpm permeate stream and an 80 gpm concentrate stream.

Although not illustrated in the figures, in various embodiments, the nanofiltration system 40 includes a prefiltration unit to remove larger contaminants from the hemicaustic stream prior to nanofiltration. Exemplary pre-filtration units are generally designed to remove contaminants having a nominal diameter of 5 microns or greater. Consequently, the pre-filtration unit can include one or more filters having a screen size ranging from about 400 to about 650 mesh. Suitable filters for use in the pre-filtration unit include any conventional filter known in the art capable of withstanding alkaline conditions such as associated with the hemicaustic stream. Nonlimiting examples of suitable pre-filters include bag filters, ribbon filters and self-cleaning filters. A pre-filtration unit is generally positioned prior to the nanofiltration unit 50. In embodiments, a buffer tank may be positioned between the pre-filtration unit and the nanofiltration unit.

When used according to the parameters described in the various embodiments, the nanofiltration system 40 permits efficient filtration of hemicellulose from the hemicaustic stream, and enables recovery of both caustic and borate. Preferably, the nanofiltration system 40 permits recovery of at least about 60%, more preferably at least about 85%, even more preferably at least about 90%, even more preferably at least about 95%, and even more preferably at least about 99%, by volume, of the incoming hemicaustic feed stream. Preferably, the nanofiltration system 40 of the various embodiments filters the hemicaustic stream such that more than about 50%, more preferably greater than about 75% and even more preferably up to 99% of the caustic content (by weight) of the hemicaustic stream entering the nanofiltration system passes through to the permeate stream. In various embodiments, greater than about 30%, more preferably greater than 50%, even more preferably greater than 70%, and even more preferably greater than 80% of the borate content (by weight) in the hemicaustic stream entering the nanofiltration system passes through to the permeate stream. In various embodiments, less than about 20%, more preferably less than about 10% and even more preferably less than about 5% of the hemicellulose content (by weight) in the hemicaustic stream entering the nanofiltration system passes through to the permeate stream.

The permeate stream exiting the one or more nanofiltration units 50 is an alkaline solution containing from about 2 wt % to about 20 wt % caustic and from about 0.3 wt % to about 8 wt % borate. Preferably, the permeate stream exiting the one or more nanofiltration units 50 is essentially free of hemicellulose. Residual hemicellulose remaining in the permeate stream exiting the one or more nanofiltration units 50 can generally range from about 0 to about 0.5 wt %. The permeate stream exiting the one or more nanofiltration units 50 may further contain more than 80 wt % water. Such dilute alkaline streams may not be suitable in all applications. Consequently, in beneficial embodiments, the nanofiltration system 40 further comprises an evaporation system 60 (shown in FIG. 3) to increase the concentration of the permeate stream exiting the nanofiltration system. The evaporation system 60 may include one or more evaporators, advantageously positioned in series. In one preferred embodiment, the nanofiltration system 40 includes an evaporation system 60 with four evaporators positioned in series. The evaporators increase the concentration of the permeate stream exiting the nanofiltration system 40 from an initial caustic concentration of about 2 wt % to about 20 wt % to a final caustic concentration of about 25 wt % to 50 wt %, and an initial borate concentration of about 0.3 wt % to about 8 wt % to a final borate concentration of about 1 wt % to about 25 wt %.

The permeate stream exiting the nanofiltration system 40 may advantageously be used as a caustic-borate solution in any suitable application. For example, the permeate stream exiting the nanofiltration system 40 may be recycled back into the extraction liquor supply system 32, as indicated in FIGS. 2 and 3. The permeate stream exiting the nanofiltration system 12 may typically constitute up to 100% of the caustic-borate solution included in the extraction liquor entering the caustic-borate extraction system 12. In advantageous embodiments, the permeate stream exiting the nanofiltration system 12 constitutes about 80 wt % of the caustic-borate solution included in the extraction liquor entering the caustic-borate extraction system 12.

The concentrate stream exiting the nanofiltration system 12 is likewise an alkaline solution containing up to 20 wt % caustic, and up to 8 wt % borate in water. However, the concentrate stream exiting the nanofiltration system 12 further contains from about 2 wt % to about 30 wt % hemicellulose. The hemicellulose within the concentrate stream exiting the nanofiltration system 12 may be utilized in numerous applications, including as a feedstock in the production of xylitol.

EXAMPLES

Example 1

Caustic-Borate Extraction

This example illustrates the benefits in purity and acetylation that result from caustic-borate extraction of wood pulp.

For this example, several hardwood pulps were obtained from Rayonier Corporation, and purified using a caustic-borate extraction process. Table 1 shows the pulp source, and conditions of the caustic-borate extraction process.

TABLE 1

Conditions of Caustic-Borate Extraction

| | Pulp Source | [NaOH] | [$Na_2B_4O_7$] | [$Na_2B_4O_7$•$10H_2O$] | Consistency | T (° C.) | Time (min) |
|---|---|---|---|---|---|---|---|
| 1 | J | 10.30% | 0 | 0 | 3.5% | 23 | 15 |
| 2 | J-R | 8.50% | 3.70% | 7.01% | 3.00% | 30 | 15 |
| 3 | J-E | 12% | 3.20% | 6.07% | 4.00% | 80 | 60 |
| | J-E ($2^{nd}$ Stage) | 2.3% | 0.6% | 1.2% | 6% | 95 | 60 |
| 4 | F | 8.50% | 0 | 0 | 3.50% | 38 | 15 |
| 5 | F-R | 8.50% | 3.70% | 7.01% | 3.50% | 30 | 15 |
| 6 | F-E | 12.00% | 3.20% | 6.07% | 4.00% | 80 | 60 |

The pulp samples that resulted from each of the above caustic-borate extraction processes, were analyzed for purity. The components of the pulp are shown in Table 2, expressed as percent weight of the fiber. S18, and S10 represent the amount of materials that can be extracted with 18% or 10% NaOH solution, respectively, which are generally used to indicate the purity of the cellulose pulp. Generally, the S18 value indicates how much residual hemicellulose is in the cellulose pulp, and the S10 value indicates the residual amount of both hemicellulose and degraded cellulose. A more precise hemicellulose measurement is obtained through the measurement of the mannose and xylose content in the pulp. I.V. is the intrinsic viscosity, which gives a measure of the cellulose change length.

TABLE 2

Purity Results for Caustic-Borate Extracted Fiber

| Sample | Pulp | S18, % | S10, % | I.V., % | Mannose, % | Xylose, % |
|---|---|---|---|---|---|---|
| 1 | J | 1.07 | 1.38 | 6.1 | 1.04 | 0.75 |
| 2 | J-R | 1.2 | 2.52 | 6.5 | 0.74 | 1.23 |

TABLE 2-continued

Purity Results for Caustic-Borate Extracted Fiber

| Sample | Pulp | S18, % | S10, % | I.V., % | Mannose, % | Xylose, % |
|---|---|---|---|---|---|---|
| 3 | J-E | 0.9 | 1.98 | 5.3 | 0.48 | 0.98 |
| J-Control | J-4 (before purification) | 3.6 | 4.71 | 6.6 | — | — |
| 4 | F | 1.5 | 3.1 | 8.4 | 1.07 | 0.97 |
| 5 | F-R | 1.09 | 2.19 | 8.3 | 0.56 | 0.89 |
| 6 | F-EKa | 0.8 | 1.91 | 7.3 | 0.36 | 0.68 |
| F-Control | F-5a (before purification) | 3.32 | 4.91 | 8.5 | — | — |

As demonstrated by the results in Table 2, the addition of borate to the cold caustic extraction is especially effective in removing mannan, thus improving the purity of the cellulose pulp.

Dry pulp samples 1-6 were subjected to acetylation. A low catalyst acetylation procedure was used. Other conditions are listed in Table 3. Also listed in Table 3 are the results of the acetylation of the foregoing samples

TABLE 3

Purity and Acetylation Results for Caustic-Borate Extracted Fiber

| | Sample | | | | | |
|---|---|---|---|---|---|---|
| | 1 | 2 | 3 | 4 | 5 | 6 |
| Pulp | J | J-R | J-E | F | F-R | F-E |
| Pulp IV dL/g | 6.1 | 6.5 | 5.3 | 8.3 | 8.4 | 6.3 |
| O.D. % | 91.11 | 91.87 | 91.61 | 92.59 | 92.40 | 91.89 |
| Method | 104 | 104 | 104 | 105 | 105 | 105 |
| Activation Temp ° C. | 31 | 31 | 29 | 35 | 35 | 33 |
| Target BV cP | 33000 | 33000 | 33000 | 42000 | 42000 | 42000 |
| Actual BV cP | 35100 | 33400 | 28800 | 42500 | 41300 | 39600 |
| Acetylation Time, min | 141 | 139 | 112 | 124 | 113 | 91 |
| Triacetate Haze | 13.5 | 17.3 | 9.9 | 11.8 | 7.0 | 9.4 |
| Triacetate Color | 11.4 | 21.8 | 20.0 | 9.8 | 6.8 | 5.4 |
| Solution Haze | 19.3 | 21.4 | 15.4 | 12.8 | 6.8 | |
| Solution color | 14.2 | 16.1 | 13.7 | 4.8 | 4.1 | |
| PV $g/cm^3$ | 19 | 56 | 83 | 61 | 201 | |

As demonstrated by the results in Table 3, it is evident that the pulps extracted with a caustic-borate solution have significantly improved cellulose acetate properties, such as lower haze and color, and higher plugging value (PV).

Example 2

Nanofiltration And Recovery of Caustic-Borate Solution

This example illustrates recovery of caustic and borate with nanofiltration from hemicaustic solution.

A softwood hemicaustic borate solution was filtered with a caustic-resistant nanofiltration membrane. The concentrations of caustic, hemicellulose, and borate in the feed, permeate, and concentrate were measured, and the results are listed in Table 4. Samples were taken at two different concentration factors. For example, at a concentration factor of 6 the hemicellulose was concentrated by 6 times—or about 83%, in volume, of the initial feed was recovered as permeate, and about 17% was retained as concentrate.

TABLE 4

Nanofiltration and Recovery of Caustic and Borate from Hemicaustic Solution

| Samples | Concentration factor | %, [NaOH] | %, [hemicellulose] | %, [$Na_2B_4O_7$] |
|---|---|---|---|---|
| Hemi with borate, feed | 1 | 6.69 | 0.36 | 1.82 |
| Hemi with borate, permeate | 1 | 6.5 | 0.01 | 1.12 |
| Hemi with borate, concentrate | 6 | 7.85 | 2.13 | 3.35 |
| Hemi with borate, permeate | 6 | 7.45 | 0.03 | 2.52 |

As can be seen in Table 4, almost all hemicellulose was rejected by the membrane, i.e., retained in the concentrate, and did not pass into the permeate. The membrane does not reject the caustic, i.e., the caustic concentrate in permeate is about the same as in the feed or concentrate. Furthermore, it is apparent from the results that a large amount of borate, about 60 to 75%, passed through the membrane to the permeate. Based on the borate concentration in the concentrate at concentration factor 6, one can find that about 70% of the borate in the initial feed was recovered in the clean permeate. At increased concentration factors, higher borate recovery rate is possible since more permeate can still be removed from the concentrate. In general, 90-95% of initial feed can be recovered as permeate, at which point borate recovery rate will reach 80-90%.

While the embodiments have been described with reference to particularly preferred embodiments and examples, those skilled in the art recognize that various modifications may be made thereto without departing from the spirit and scope thereof.

What is claimed is:

1. A method of recovering a caustic-borate extraction solution from a hemicaustic effluent stream comprising:

providing an aqueous hemicaustic stream comprising a caustic compound, a borate compound, and hemicellulose, wherein the hemicaustic stream has a pH greater than 12;

providing a nanofiltration system comprising at least one but no more than three alkali-resistant nanofiltration membranes;

passing the aqueous hemicaustic stream through the nanofiltration system to produce a permeate stream comprising the caustic compound, the borate compound, and hemicellulose, wherein less than about 20% by weight of the hemicellulose in the hemicaustic stream passes through the nanofiltration system to the permeate stream, and the borate concentration of the permeate stream is from about 60% to about 95% of the borate concentration of the hemicaustic stream, and greater than about 50% by weight of the caustic in the hemicaustic stream passes through the nanofiltration system to the permeate stream.

2. The method of claim 1, wherein the aqueous hemicaustic stream comprises up to about 20 weight % caustic, and up to about 8 weight % borate.

3. The method of claim 1, wherein the aqueous hemicaustic stream comprises from about 0.5 weight % to about 7 weight % of hemicellulose.

4. The method of claim 1, wherein the permeate stream comprises up to about 20 weight % caustic, and up to about 8 weight % borate.

5. The method of claim 1, wherein the permeate stream comprises less than about 0. 5 weight % hemicellulose.

6. The method of claim 1, wherein a concentrate stream is produced from that portion of the hemicaustic stream that does not permeate the nanofiltration system, wherein the concentrate stream comprises from about 2 weight % to about 30 weight % hemicellulose.

7. The method of claim 1, wherein the nanofiltration system comprises at least one nanofiltration membrane capable of excluding compounds having a molecular weight greater than about 200.

8. The method of claim 1, wherein the nanofiltration system comprises at least one nanofiltration membrane comprising a polymer selected from the group consisting of polyether sulfone, polysulfone, polyarylether sulfone, polyvinylidene fluoride, polyvinyl chloride, polyketone, polyether ketone, polytetrafluoro ethylene, polypropylene, polyamide, and any combination or mixture thereof.

9. The method of claim 1, wherein at least about 60% of the volume of the hemicaustic stream is recovered in the permeate stream.

10. The method of claim 1, further comprising the step of concentrating the permeate stream by removing water, to increase the concentration of caustic and borate.

11. The method of claim 10, wherein the step of concentrating the permeate comprises introducing the permeate stream to at least one evaporator unit.

12. The method of claim 10, wherein the concentration of caustic in the concentrated permeate from about 25 weight % to about 50 weight %, and the concentration of borate in the concentrated permeate is from about 1 weight % to about 25 weight %.

13. The method of claim 1, wherein said step of providing an aqueous hemicaustic stream further comprises:

providing cellulose fibers containing hemicellulose;

providing an extraction liquor comprising an aqueous solution of caustic and borate;

combining the cellulose fibers and the extraction liquor to produce a caustic-borate cellulose fiber slurry;

extracting the caustic-borate cellulosic fiber slurry for a sufficient amount of time to dissolve and extract the hemicellulose from the cellulosic fibers and into the extraction liquor;

washing the extracted cellulose slurry to produce a hemicaustic stream comprising the spent extraction liquor and the dissolved hemicellulose.

14. The method of claim 13, wherein the cellulose fibers are provided in an aqueous slurry having a consistency of less than about 10%.

15. The method of claim 13, wherein the step of combining the cellulose fibers and extraction liquor comprises passing the cellulose fibers through at least one washer unit through which the caustic-borate extraction liquor is introduced in a counter-current direction to the cellulosic fibers.

16. The method of claim 14, wherein the step of combining the cellulose fibers and extraction liquor comprises pressing the cellulose fiber slurry to increase the consistency of the slurry to about 30% to about 40%, and thereafter combining the concentrated cellulose slurry with a caustic-borate extraction liquor.

17. The method of claim 13, wherein the caustic-borate cellulose slurry comprises from about 2 weight % to about 20 weight % caustic.

18. The method of claim 13, wherein the caustic-borate cellulose slurry comprises from about 7 weight % to about 14 weight % caustic compound.

19. The method of claim 13, wherein the caustic-borate cellulose slurry comprises from about 0.5 weight % to about 10 weight % borate.

20. The method of claim 13, wherein the caustic-borate cellulosic slurry has a pH of about 14.

21. The method of claim 13, wherein the step of extracting the caustic-borate cellulose slurry is performed at a temperature of from about 20° C. to about 100° C.

22. The method of claim 13, wherein the step of washing comprises passing the extracted cellulose slurry through at least one washer that applies wash water to the extracted cellulose slurry, and removes a substantial portion of the spent caustic-borate extraction solution, and removes a substantial portion of the hemicellulose from the slurry.

23. The method of claim 13, wherein at least a portion of the hemicaustic stream is diverted and combined with the cellulose slurry before the extraction step.

* * * * *